US005431130A

United States Patent [19]

Brackett

[11] Patent Number: 5,431,130

[45] Date of Patent: Jul. 11, 1995

[54] INTERNAL COMBUSTION ENGINE WITH STROKE SPECIALIZED CYLINDERS

[76] Inventor: Douglas C. Brackett, P.O. Box 306, Portland, Me. 04112

[21] Appl. No.: 149,063

[22] Filed: Nov. 8, 1993

[51] Int. Cl.[6] ..... F02B 75/28

[52] U.S. Cl. ..... 123/70 R; 123/190.2; 123/197.2; 123/53.3; 123/53.5

[58] Field of Search ..... 123/55 R, 56 R, 56 A, 123/56 AA, 56 B, 56 BA, 70 R, 197.1, 197.2; 74/49, 50

[56] References Cited

U.S. PATENT DOCUMENTS

| | | | |
|---|---|---|---|
| 130,371 | 8/1872 | Hendryx | 74/49 |
| 139,499 | 6/1873 | Doolittle | 74/44 |
| 283,558 | 8/1883 | Baumgarten . | |
| 347,644 | 8/1886 | Salmon | 92/74 |
| 410,432 | 9/1889 | McKaig | 92/136 |
| 637,450 | 11/1899 | Doolittle | 123/294 |
| 762,646 | 6/1904 | Morison | 74/49 |
| 1,349,660 | 8/1920 | Buhl . | |
| 1,505,856 | 8/1924 | Briggs . | |
| 1,508,614 | 9/1924 | Powell . | |
| 2,312,057 | 2/1943 | Williams | 74/49 |
| 3,961,607 | 6/1976 | Brems | 123/78 R |
| 4,013,048 | 3/1977 | Reitz | 123/197.2 |
| 4,270,395 | 6/1981 | Grundy | 74/49 |
| 4,339,960 | 7/1982 | Senat | 60/518 |
| 4,370,901 | 2/1983 | Bolen | 123/78 E |
| 4,408,578 | 10/1983 | Konther et al. | 123/197.1 |
| 4,459,945 | 7/1984 | Chatfield | 123/56 C |
| 4,463,710 | 8/1984 | McWhorter | 123/78 B |
| 4,485,768 | 12/1984 | Heniges | 123/48 B |
| 4,512,291 | 4/1985 | Kirk | 123/56 BC |
| 4,565,167 | 1/1986 | Bryant | 123/70 R |
| 4,584,972 | 4/1986 | Jayne et al. | 123/56 C |
| 4,598,672 | 7/1986 | Jayne et al. | 123/56 BC |
| 4,685,342 | 8/1987 | Brackett | 74/569 |
| 4,715,326 | 12/1987 | Thring | 123/70 R |
| 4,779,472 | 10/1988 | Brackett | 74/50 |
| 4,803,890 | 2/1989 | Giuliani et al. | 74/131 |
| 4,884,536 | 12/1989 | Neale et al. | 123/197.4 |
| 4,887,560 | 12/1989 | Heniges | 123/78 F |
| 4,915,019 | 4/1990 | Hovaguimian | 74/435 |
| 4,977,864 | 12/1990 | Grant | 123/56 BC |
| 4,979,427 | 12/1990 | Pfeffer et al. | 92/82 |
| 4,995,354 | 2/1991 | Morikawa | 123/190.2 |
| 5,259,256 | 11/1993 | Brackett | 123/56 AC |
| 5,265,564 | 11/1993 | Dullaway | 123/70 R |

FOREIGN PATENT DOCUMENTS 533047 2/1941 United Kingdom .

*Primary Examiner*—David A. Okonsky
*Attorney, Agent, or Firm*—Ralph W. Selitto, Jr.

[57] ABSTRACT

A multi-cylinder reciprocating piston internal combustion engine is divided into a working section and a compressor section, with the working section supporting the combustion function and the compressor dedicated solely to infusion of intake charge into the working section. In a preferred embodiment, the compressor employs a scotch yoke motion translator with cycle dynamics matched to optimize compressor function. This is characterized by a displacement of crankshaft orientation from 0 degrees at top piston position. The working portion employs a scotch yoke motion converter exhibiting cycle dynamics matched to either a two, four, or diesel engine power cycle.

17 Claims, 13 Drawing Sheets

INTERNAL COMBUSTION ENGINE WITH STROKE SPECIALIZED CYLINDERS

FIELD OF THE INVENTION

The present invention relates to internal combustion engines, and more particularly to reciprocating piston engines utilizing scotch yoke rectilinear-to-rotary motion translation.

BACKGROUND OF THE INVENTION

Numerous engine designs have been proposed over the years for achieving various performance characteristics. The most familiar design is the slider crank reciprocating piston internal combustion engine. In the slider crank engine a connecting rod connects the piston(s) to the offset crankpins of a crankshaft to translate the linear reciprocating motion of the pistons to rotary motion. While the slider crank design has proven to have great utility, it does have certain disadvantages and limitations, e,g., the number and weight of engine parts, size, and power loss due to friction associated with side loading of pistons, as well as pumping losses. The slider crank also has limitations as to volumetric efficiency arising from the fixed cycle dynamics of the slider crank engine, wherein the Top Dead Center (TDC) position of the crankshaft invariably corresponds to Top Piston Position (TPP) in the cylinder and the Bottom Dead Center (BDC) position corresponds to Bottom Piston Position (BPP).

Of course, the cycle dynamics of an engine (piston position and velocity/cylinder volume and rate of volume change as a function of crankshaft position) has a direct effect upon the thermodynamics of the engine (pressure/temperature and rate of change thereof) which has a direct effect upon the chemical reactions driving the engine (exothermic oxidation of fuel). Each of the foregoing determine the efficiency of the engine and the nature of the exhausted end products of combustion.

A variety of expedients for improving the slider crank engine have been considered over the years, including devices for altering the cycle dynamics of the engine. For example, the following devices have been proposed: pistons with variable compression height, see U.S. Pat. No. 4,979,427, connecting rods with variable length, see U.S. Pat. No. 4,370,901; connecting rods with a pair of wrist pins one of which is connected to an internal slider and the second of which traverses an arcuate slot, see U.S. Pat. No. 4,463,710; and supplemental pistons and cylinders converging into a shared combustion chamber, see U.S. Pat. No. 3,961,607. Each of these devices results in a more complex engine having more parts and greater reciprocating and total mass.

A more common expedient for overcoming volumetric inefficiency and to provide an optimal fuel air mixture at high RPMs is the air intake compressor. A variety of compressor types have been suggested in the past. Of these, the supercharger, e.g., Root's type, and the turbo charger are the most common. Compressors of this type are discrete pump units fitted to an engine and driven at a selected ratio of compressor shaft speed to engine shaft speed. In the case of the turbo charger, the compressor is driven by a turbine positioned in the engine exhaust stream and thus has no mechanical connection to the engine crank, leading to "turbo lag". Due to the high RPMs and close tolerances required by turbo chargers and superchargers to develop pressure boost, these accessories are generally expensive and degrade prior to the engine upon which they are installed. For these reasons they are sometimes considered appropriate only for exotic or performance applications.

The scotch yoke has also been employed in certain engine designs seeking improved cycle dynamics over the slider crank engine. For example, see U.S. Pat. Nos. 4,584,972, 4,887,560, 4,485,768 and 4,803,890. While these efforts certainly must be considered creative, they either utilize a great number of parts in a complex arrangement or are plagued by certain weaknesses encountered in the traditional scotch yoke design, such as unacceptable wear and tear at the crank/slot interface. Furthermore, the benefits of changes in cycle dynamics are limited because more than one stroke of a cycle must be provided for, i.e., intake, compression, power and exhaust, each stroke having different optimal cycle dynamics.

The present application then seeks to describe a new and novel engine having improved cycle dynamics which employs a scotch yoke motion translator. The engine is also capable of developing a more optimal fuel/air over a wider range of operating speeds thereby providing a more efficient engine with a higher power to weight ratio, reduced pumping losses and reduced pollution emissions.

SUMMARY OF THE INVENTION

The problems and disadvantages associated with conventional reciprocating piston internal combustion engines are overcome by the present invention which includes a reciprocating piston internal combustion engine having a plurality of cylinders for slideably receiving a corresponding plurality of mating pistons therein moving in synchronous reciprocation relative to the rotation of a crankshaft. A shuttle having a slot therein is affixed to a first of the plurality of pistons, with the slot receiving a crankpin of the crankshaft for interconverting between reciprocating motion of the first piston and rotary motion of the crankshaft. The interconversion is characterized by an angular displacement of the crankshaft from 0 degrees at top piston position. The remainder of the plurality of pistons have apparatus associated therewith for interconverting between reciprocating motion thereof and rotary motion of the crankshaft. At least one of the plurality of cylinders is dedicated to infusing an intake charge into at least one other of the plurality of cylinders at the exclusion of combustion within the dedicated cylinder, any infused cylinder being capable of serving as a combustion chamber.

BRIEF DESCRIPTION OF THE FIGURES

For a better understanding of the present invention, reference is made to the following detailed description of an exemplary embodiment considered in conjunction with the accompanying drawings, in which.

DESCRIPTION OF THE EXEMPLARY EMBODIMENTS

Figure 1:
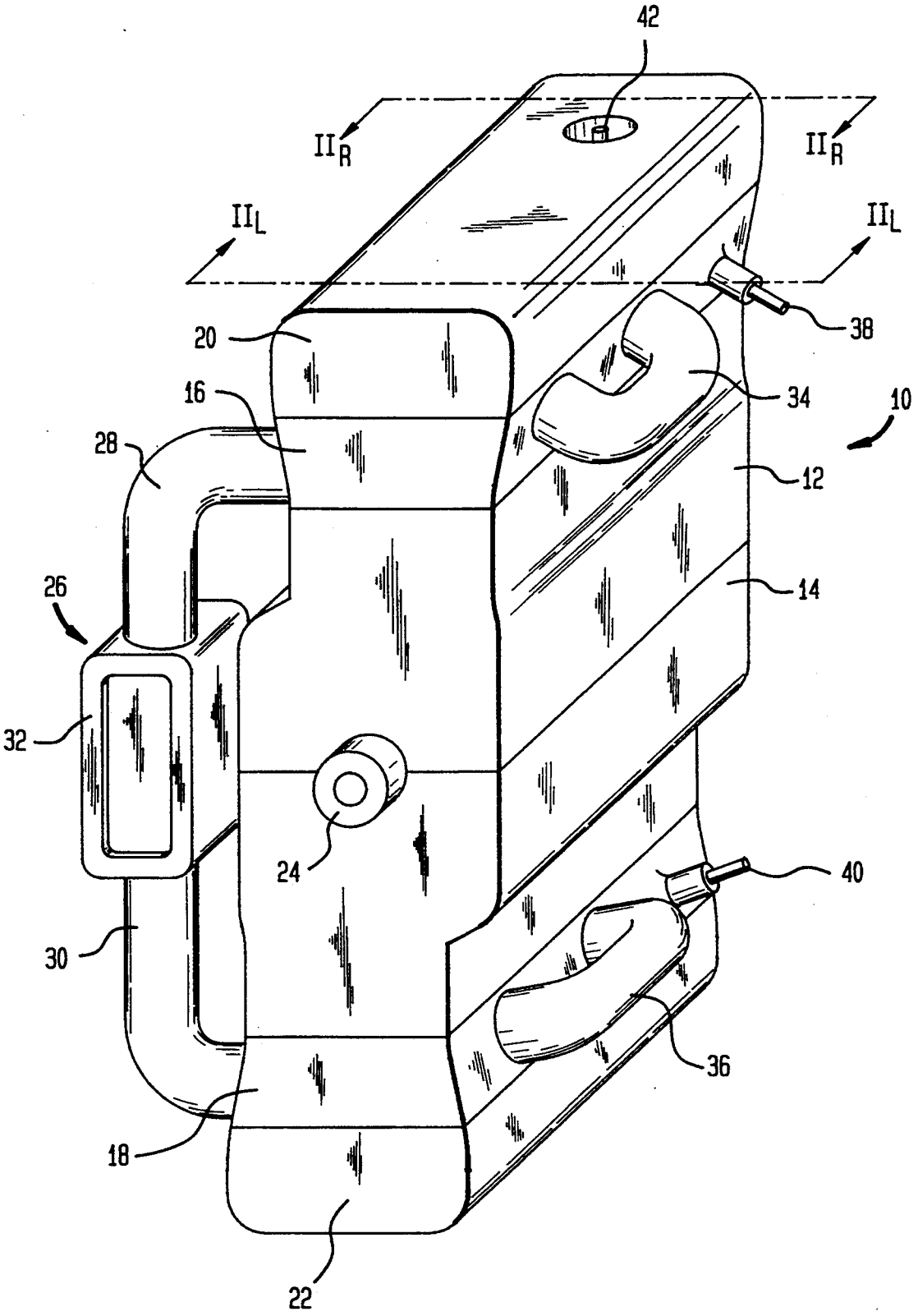
FIG. 1 is a perspective view of an internal combustion engine constructed in accordance with a first exemplary embodiment of the present invention.

FIG. 1 shows an engine 10 constructed in accordance with the present invention. The engine 10 has a pair of cylinder blocks 12, 14 each having a pair of cylinders and mating pistons therein, as shall be seen in FIG. 2. Cylinder heads 16, 18 with valve train covers 20, 22 are attached to the blocks 12, 14 in a conventional manner. A centrally disposed crankshaft 24 is captured between the opposing blocks 12, 14 such that the engine depicted can be described as a horizontally opposed engine. As shall be evident from the following description, the present invention can be practiced in other engine configurations, such as rotary, Vee and in-line. An intake manifold 26 has runners 28, 30 emanating from a common plenum 32 and feeding into corresponding ports in the heads 16, 18 of an opposed cylinder pair. The plenum 32 is adapted to connect to an air duct, an air cleaner or a carburetor, as in conventional engines. On the opposite side of the engine 10, a pair of bridge manifolds 34, 36 join cylinder head ports communicating with adjacent cylinders as shall be depicted and described more fully below. A pair of fuel injectors 38, 40 are threaded into the cylinder heads 16, 18 to supply fuel to the cylinders in which combustion takes place. Of course, fuel injectors would not be needed if a carburetor is employed at the intake manifold plenum 32. A spark plug 42 is provided for initiating combustion of corresponding spark plug 43 on the opposing side of the engine 10 is not visible in this view.

Figure 2:
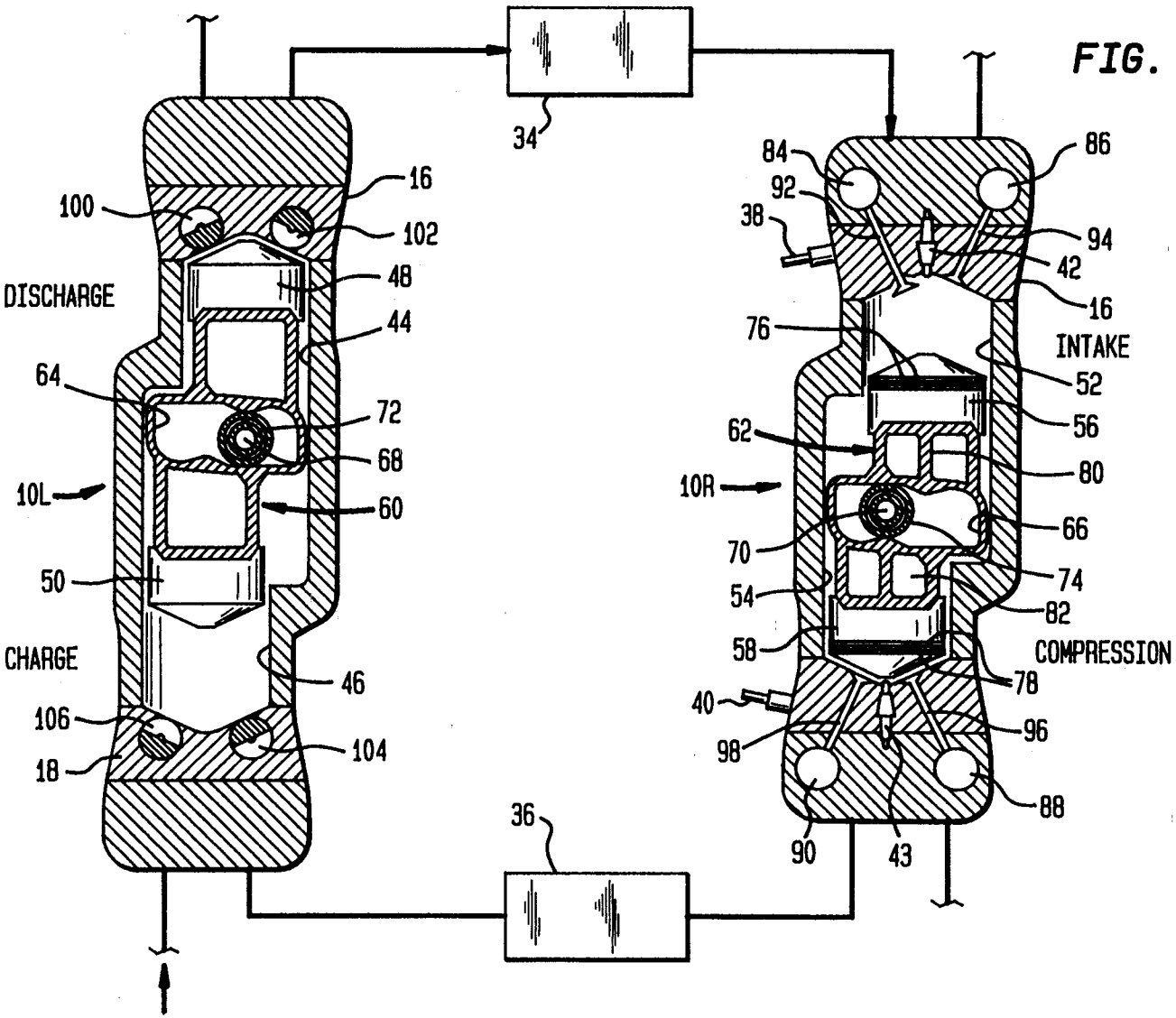
FIG.2 is a cross-sectional, partially diagrammic view of the engine of FIG. 1 showing airflows through and between two portions of the engine at a first crankshaft position and shown in a pair of juxtaposed cross-sections, a first, on the left of FIG. 2, being taken along line IIL—IIL of FIG. 1 and looking in the direction of the arrows and a second, on the right of FIG. 2, being taken along line IIR—IIR of FIG. 1 and looking in the direction of the arrows.

FIG. 2 shows the internal components of the engine 10 at a selected crankshaft orientation and viewed at two cross-sectional perspectives 10L, 10R ("L" and "R" for Left and Right). 10L is a view of the front cylinders 44, 46 and pistons 48, 50 looking from the front of the engine 10 to the rear and 10R is a view of the rear cylinders 52, 54 and pistons 56, 58 looking from rear to front. The piston pairs 48, 50 and 56, 58 running in opposing cylinders are supported on shuttles 60, 62. The shuttles 60, 62 have a slot 64, 66 therein accommodating the crankpins 68, 70 of the crankshaft 24. Roller bearings 72, 74 reduce the frictional interaction between the crankpins 68, 70 and slots 64, 66 during rotation of the crankshaft 24. The crankpin 68 is at a 180 degree offset from crankpin 70, each crankpin 68, 70 being radially offset from the crankshaft 24 axis of rotation (which for present purposes can be viewed as the axis of symmetry of 10L and 10R). As can be appreciated, the apparatus shown for converting linear motion of the pistons 48, 50, 56, 58 to rotary motion of the crankshaft 24 can be described as of the scotch yoke type. A comparison between 10L and 10R reveals that pistons 56 and 58 have compression and oil control rings 76, 78 whereas pistons 48, 50 of 10L are devoid of rings. Shuttle 62 of 10R includes bracing members 80, 82, whereas shuttle 60 is devoid of such members. These differences are related to the different functions for the respective cylinder/piston sets, namely, that portion of the engine labelled 10L is intended to act a compressor only, while 10R is a working four-cycle engine. Accordingly, the bracing members are not required on shuttle 60 because it does not handle the severe loading forces associated with combustion. Similarly, blowby in the compressor 10L does not produce the ill effects of pollution and lubricant dilution as in the combustion portion 10R. The 10R portion includes fuel injectors 38, 40 and spark plugs 42, 43, whereas the compressor portion 10L has no need for such components. The valving arrangements associated with 10L and 10R may also be function specific to thereby achieve economies of production and efficiency in operation. 10R requires conventional camshaft 84, 86, 88, 90 actuated poppet valves 92, 94, 96, 98, but rotary or reed valves 100, 102, 104, 106, as are conventional in compressors, can be used in the compressor portion of the engine 10L. Thus, it can be seen that certain specialization is realizable between the compressor portion 10L and the working portion 10R. The compressor portion 10L can be made of lighter materials with a lower reciprocating mass; it can have fewer moving parts and create less internal friction than the working portion of the engine. More importantly, the cycle dynamics of the respective stroke specialized engine portions (cylinders) can be tailored to perform that particular stroke most effectively and efficiently by selecting a slot 64, 66 (cam) shape which is optimal for each stroke specialized cylinder. The inventor of the present invention has, in previous and copending applications described a variety of scotch yoke type motion translators wherein means for selecting a "slot" shape are disclosed. For example, applicant's U.S. Pat. No. 4,685,342 and his copending U.S. patent application Ser. No. 07/924,547 filed Jul. 31, 1992 entitled Motion Converter with Pinion Sector/Rack Interface relate to apparatus for providing a superior crank/slot interface, slots of various shapes and resulting scotch yoke mechanism of improved utility. A copending application filed concurrently herewith and entitled Internal Combustion Engine with Improved Cycle Dynamics, application no. to be assigned describes how the selection of shuttle slot cam shape can be used to effect particular cycle dynamics and how cycle dynamics can be optimally correlated to the thermodynamic processes occurring within the cylinder. Each of these applications and the patent shall be described further below.

An important aspect of the present invention is that by apportioning the thermodynamic processes associated with each stroke in a heat engine cycle between specialized cylinders, the cycle dynamics of such specialized cylinders can be optimized without compromising for multi-stroke function. That is, the cylinder which is tasked with infusing air into the engine, i.e., the compressor section, has different cycle dynamic requirements than the cylinder in which the compression, expansion and exhaust strokes take place. By specializing cylinder function, cycle dynamics may then be more closely matched to the particular specialized task. Having now described certain aspects of the present invention statically, its function shall now be described. Before doing so, it should be noted that certain features of the present invention are shown diagrammatically in the Figures to more easily illustrate function. For example, in FIG. 2, the bridge manifolds 34, 36 are illustrated as rectangles intermediate engine portions 10L and 10R. Flows of air and exhaust gasses to and from the cylinders of the engine are depicted as lines originating or terminating proximate to the valve which controls such flows. The compressor valves 100, 102, 104, 106 are depicted as open when the solid portion is distal to the cylinder with which it is associated. These and other drawing conventions shall be apparent in the following description.

Referring again to FIG. 2, one can appreciate that piston 48 is at or proximate to the top piston position (TPP) within cylinder 44. Thus, piston 48 is at the end of the discharge stroke in upper cylinder 44 and at the beginning of the charge stroke when it will draw ambient air or air/fuel mixture through valve 100. The terminology "charge" shall be used to describe the intake strokes of compressor portion 10L to differentiate between the intake stroke of the working portion 10R. In the position shown, valve 102 is releasing air from the cylinder 44 through a port in cylinder head 16 to the bridge manifold 34 which is basically a conduit. Bridge manifold 34 has an internal volumetric capacity preselected by the designer of the engine preferably approximating the swept volume of its corresponding working cylinder, e.g., 52. The manifold 34 discharges into an intake port in the cylinder head sealing cylinder 52 of the working portion 10R. Examining working portion 10R one can note that piston 56 is at or proximate to the bottom piston position (BPP) within cylinder 52 and that poppet valve 92 is open thereby allowing the pressurized air residing in bridge manifold 34 to enter the cylinder 52. This indicates the intake stroke in the four-stroke cycle of working portion 10R of the engine. Simultaneously with or shortly after the intake stroke, a stream of fuel to be ignited is injected into the cylinder 52 through fuel injector 38. The intake valve 92 closes subsequently for compression as is conventional. It should be observed that while the four-stroke cycle is being described herein with reference to FIG. 2–5 the diesel cycle could be employed as well. In that case, fuel would not be injected until the approximate completion of the compression stroke. In any event, the air discharged from cylinder 44 is pumped by piston 48 into bridge manifold 34 which essentially functions as a plenum for receiving pressurized air and/or fuel/air mixture until such time as intake valve 92 is opened and cylinder 52 is on the intake stroke whereby the pressurized air is allowed to enter cylinder 52. Upon examining piston 50 within cylinder 46 of the compressor portion 10L, it can be appreciated that piston 50 is at or proximate to the bottom piston position within cylinder 46 and that valve 106 is open allowing air to enter the cylinder through a suitable port in the cylinder head 18. The air would be conducted through the intake manifold 26 by plenum 32 and runners 28 and 30. Valve 104 is in the closed position maintaining the bridge manifold 36 in stasis. In the working portion of the engine 10R, piston 58 within cylinder 54 is approximately at the top piston position with both poppet valves 96 and 98 closed. One can recognize this position as the end of the compression stroke and the beginning of the power stroke for a four-stroke cycle.

Figure 3:
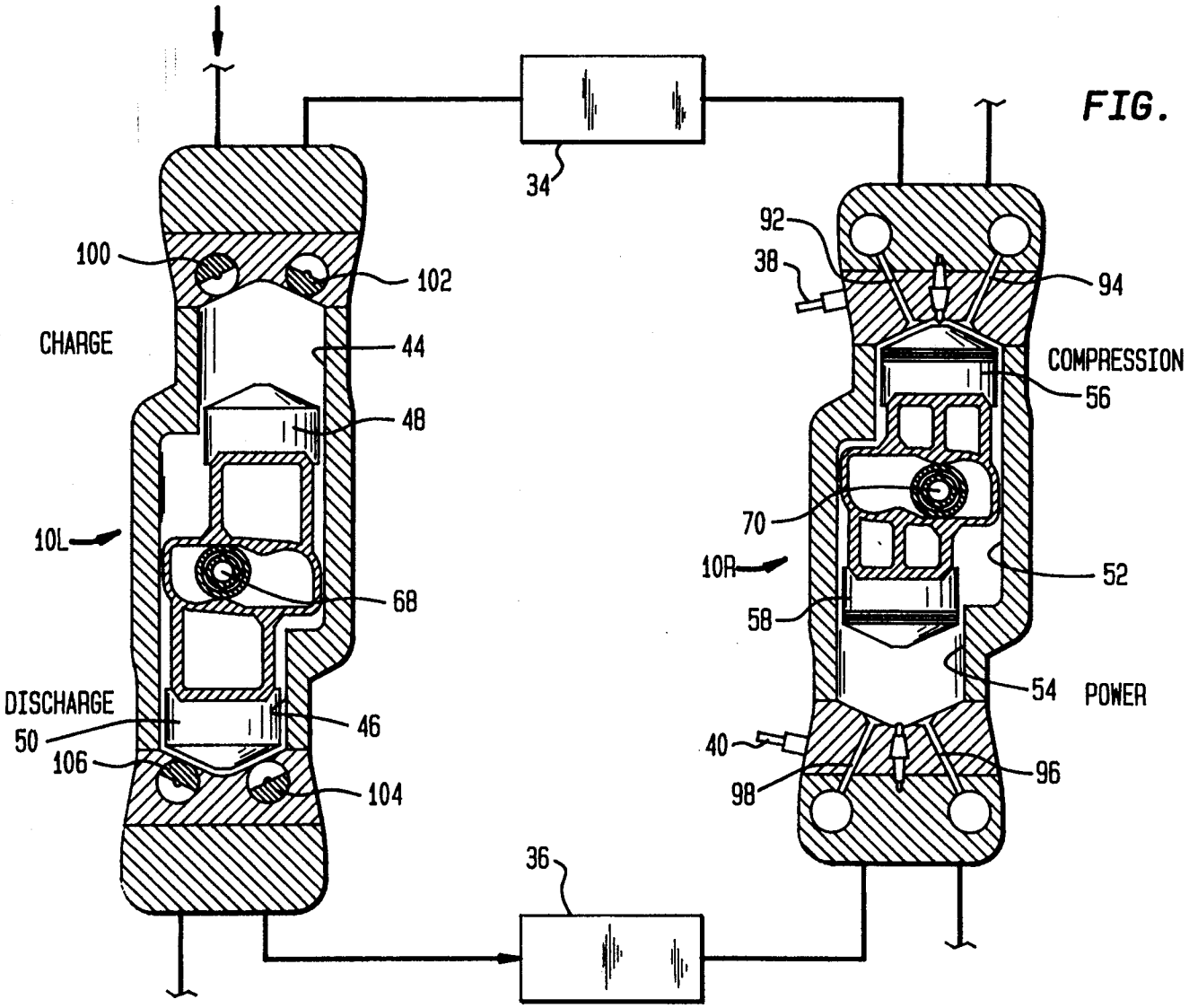
FIG. 3 is the same view of the engine as shown in FIG. 2, but at a second crankshaft position.

FIG. 3 shows the position of the various pistons within their respective cylinders in the compressor and working portions of the engines 10L and 10R after the crankshaft has advanced 180 degrees from the position occupied in FIG. 2. As can be seen, piston 48 is proximate to the bottom piston position within cylinder 44 and inlet valve 100 is open permitting air to enter cylinder 44. Valve 102 is closed such that bridge manifold 34 is isolated from the cylinder 44. Thus, piston 48 is at the end of the charging stroke of the compressor portion 10L and at the beginning of the discharge stroke. Bridge manifold 34 having discharged its contents into cylinder 52 during the intake stroke of 10R illustrated in FIG. 2 is in a substantially depressurized state. Piston 56 within cylinder 52 is proximate to top piston position and since the previous state shown in FIG. 2 was at BPP on intake, it is now at TPP of the compression stroke of a four-stroke cycle. As such, both poppet valves 92 and 94 are closed. Piston 50 in engine segment 10L is at top piston position within cylinder 46 and that cylinder is in the discharge phase of the two-stroke charge/discharge cycle of the compressor portion 10L. As such, inlet valve 106 is closed and outlet valve 104 leading to bridge manifold 36 is open. Unlike the previous situation as illustrated in FIG. 2, wherein the discharge stroke of 10L was occurring simultaneously with the intake stroke of the matched cylinder within the working portion 10R, in FIG. 3, the matched working cylinder in 10R, namely, cylinder 54, is undergoing the expansion or power stroke and combustion has driven piston 58 towards the bottom piston position. In this state, poppet valves 96 and 98 are closed and the discharge from cylinder 46 is received totally within the bridge manifold 36. This illustrates that, if 10R is a four-cycle engine the two-cycle compressor portion 10L completes two full cycles for every one cycle completed by the working portion 10R. As a result, each cylinder 44 and 46 executes two discharge strokes for every intake stroke in cylinders 52 and 54. One discharge stroke of the compressor portion is therefore stored in the bridge manifold. The second discharge stroke is executed at the time when the corresponding power cylinder is executing an intake stroke. Therefore, during the intake stroke the working portion 10R receives a double charge of air from the manifold/compressor.

Figure 4:
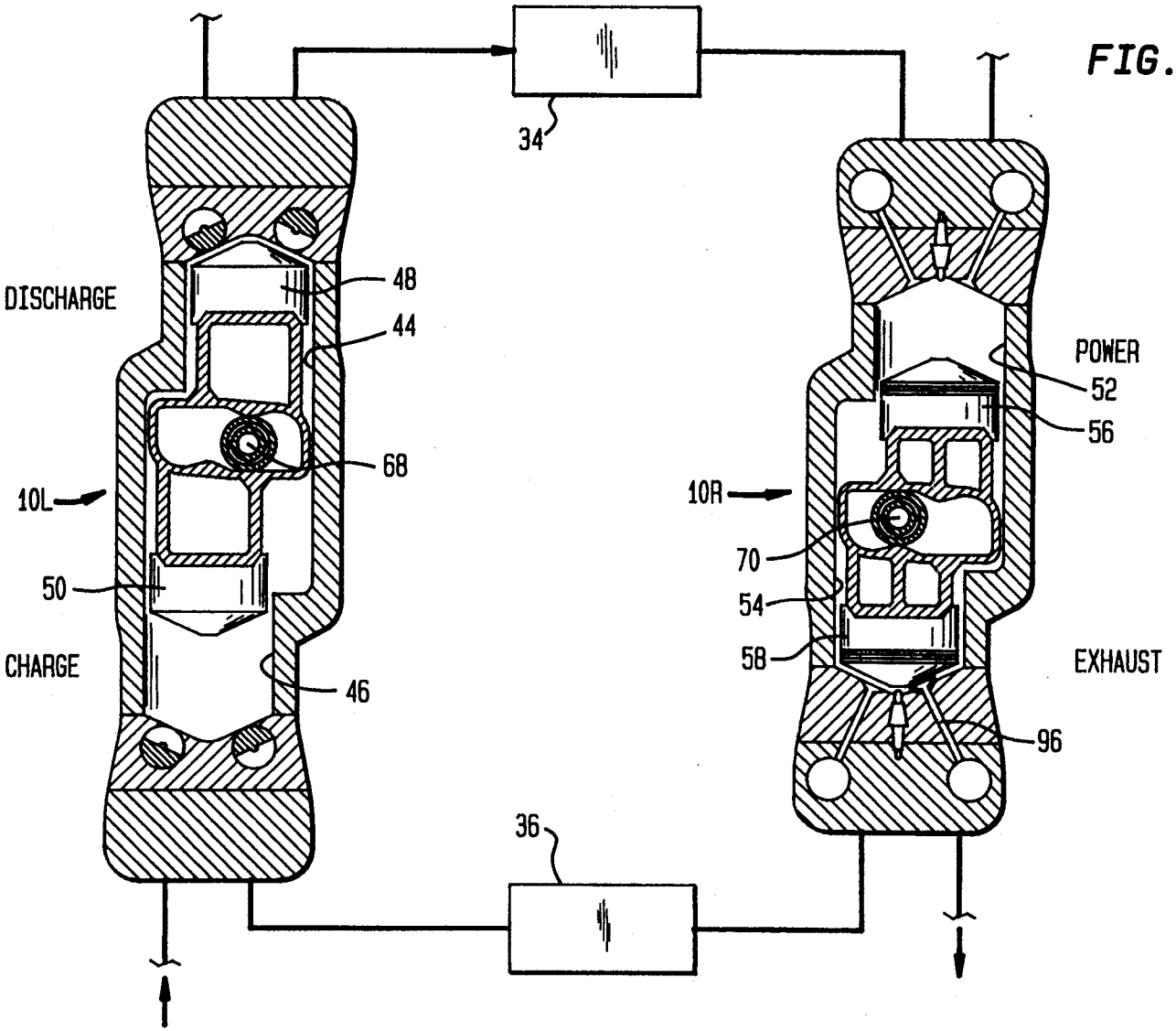
FIG. 4 is the same view of the engine as shown in FIGS. 2 and 3, but at a third crankshaft position.

FIG. 4 shows the engine with the crankshaft 24 and crankpins 68 and 78 having been rotated 180 degrees from the position shown in FIG. 3. This position is the same as that shown in FIG. 2 and the compressor portion 10L has gone through one complete cycle of operation with the working portion 10R going through one half of a complete cycle. In FIG. 4, the piston 56 is undergoing the power stroke with piston 58 exhausting exhaust gases through poppet valve 96 to the atmosphere via a suitable exhaust system.

Figure 5:
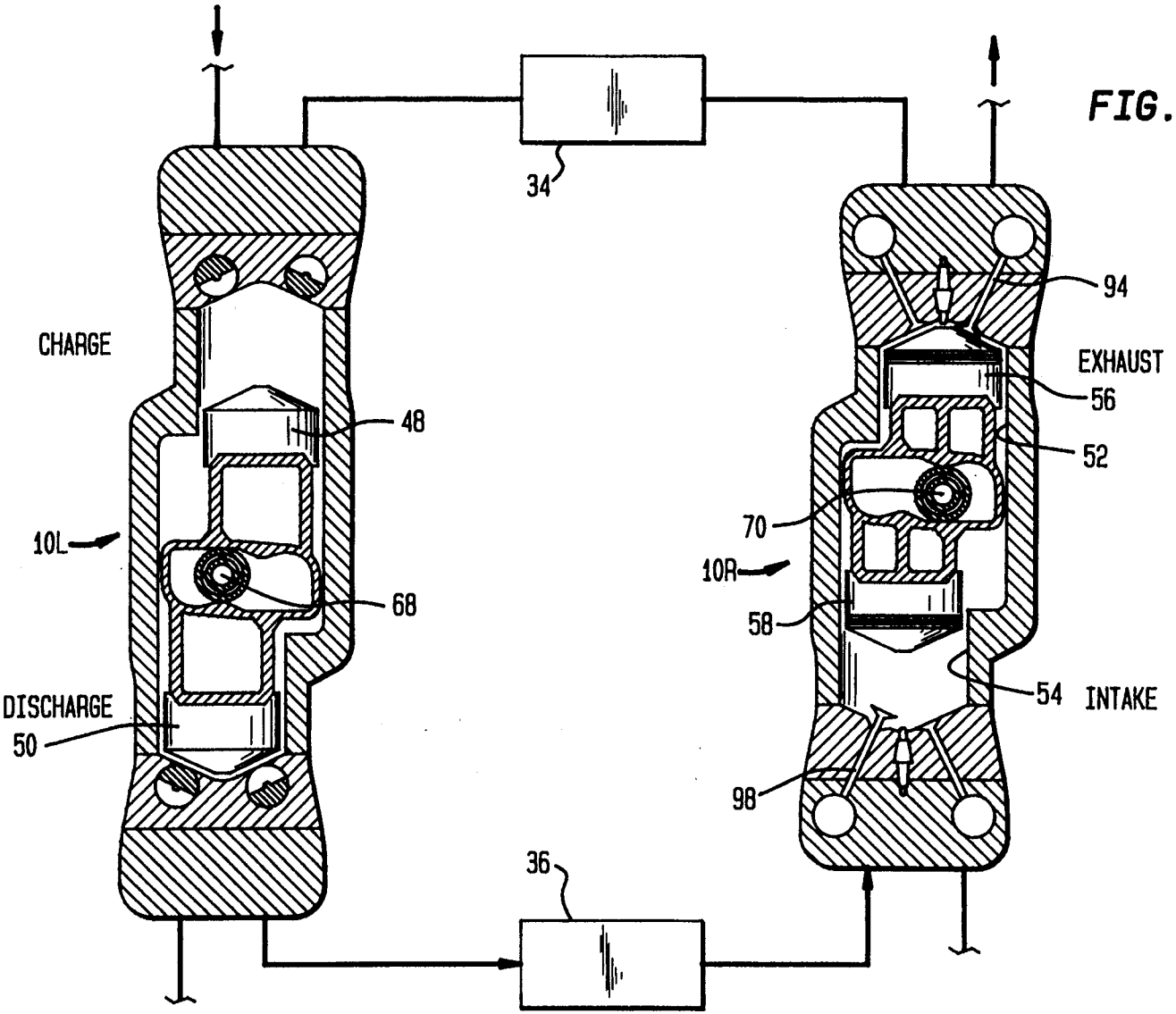
FIG. 5 is the same view of the engine as shown in FIGS. 2, 3 and 4, but at a fourth crankshaft position.

In FIG. 5, the crank pins 68 and 70 have advanced another 180 degrees and the cycle of the working portion of the engine 10R is completed. At this phase, piston 56 is exhausting exhaust gases through poppet valve 94 to the atmosphere and piston 58 is at or proximate to bottom piston position during the intake stroke. Poppet valve 98 is open allowing the compressed air contained within bridge manifold 36 to enter cylinder 54.

Given the overall design depicted in FIGS. 1–5, it should be appreciated that the present invention can be expected to exhibit certain beneficial attributes of scotch yoke engines. For example, like other scotch yoke designs, this design substantially eliminates side thrust between piston and cylinder wall since the shuttle travels in a straight line with the side loads being divided approximately equally between two pistons. This results in a reduction in the frictional losses due to piston side loading. In the embodiment depicted, the shuttle bears upon opposing crankcase walls further attenuating side loading of cylinders. Further, since there is a reduction in side loading, a better seal can be effected by the piston rings. Better ring seal prevents blowby and the attendant hydrocarbon pollution and dilution of engine lubricant with fuel. Reduced side loading also permits a smaller piston skirt to be employed thereby shaving weight from the reciprocating mass and increasing engine performance and efficiency. The present invention also has the balance characteristics of scotch yoke engines which exceed the pendulous slider crank engine, eliminating the need for expensive counter-rotating balance shafts which have come into common use. In addition, the benefits of decreased engine size are realized in accordance with the general rule that scotch yoke designs are smaller than slider crank engines of equal displacement.

A primary benefit of the present invention, as illustrated in FIGS. 1–5, is that the cycle dynamics of the respective cylinder groups comprising the working portion of the engine 10R and the compressor portion 10L can be tailored to the specific function performed therein. This is accomplished by varying the shape of the cam surface of the slot in the respective shuttles 64, 66. This aspect of scotch yoke engine design whereby cycle dynamics has been altered in non-specialized cylinders is extensively described in previous patents and pending patent applications of the inventor herein. For example, in U.S. Pat. No. 4,685,342 to Douglas C. Brackett the inventor herein entitled "Device for Converting a Linear Motion to Rotary Motion or Vice Versa" discloses a scotch yoke device having a pair of opposing offset bearing surfaces, one on either side of the crankpin slot in the shuttle. A corresponding pair of roller bearings are arranged on the crankpin coaxially and laterally displaced from one another such that each aligns with one of the pair of opposing offset bearing surfaces of a slot of a selected shape when the crankpin is inserted into the slot. In this manner, clearance at crankpin/slot interface can be minimized to manufacturing tolerances and friction is reduced to the rolling friction of a roller bearing and the cam shape of the slot can be varied. The inventor herein has recently proposed additional solutions to traditional problem in scotch yoke design. In copending application Ser. No. 07/924,547 entitled "Motion Converter with Pinion Sector/Rack Interface", a simple and effective arrangement wherein a pair of opposing gear racks disposed within the shuttle slot capture a pair of free floating sector segments disposed about the crankpin of the crankshaft to be turned is disclosed. In copending application filed herewith and entitled "Internal Combustion Engine With Improved Cycle Dynamics", the inventor herein has described an engine with non-specialized cylinders having a scotch yoke motion translator which alters the cycle dynamics of the engine from that of a slider crank engine. This application describes at length the means whereby the cycle dynamics of a reciprocating internal combustion engine can be changed by changing the shape of gear racks disposed within the shuttle slot and the shuttle slot itself in order to provide beneficial thermodynamic effects which are also described at length in that application. Applicant incorporates by reference each of the foregoing applications and U.S. Pat. No. 4,685,342 to the inventor herein for their teachings in this regard.

The foregoing references illustrate that the cycle dynamics of a scotch yoke engine can be varied over a wide range. Considering first the cycle dynamics of the compressor portion 10L of the engine described with respect to FIGS. 1–5, the cycle dynamics thereof may be altered from that of the slider crank engine, e.g., by designing a cam slot 64, 66 shape resulting in a cycle having a 15 degree offset from a slider crank cycle. In that instance, the following correspondence of piston position to crank angle would exist as compared to a slider crank engine.

| PRESENT INVENTION crank angle | SLIDER CRANK crank angle for same piston position |
|---|---|
| INTAKE/"CHARGE" | |
| 15 | 0 |
| 54 | 44 |
| 76 | 64 |
| 95 | 82 |
| 116 | 100 |
| 142 | 124 |
| 195 | 180 |
| EXHAUST/"DISCHARGE" | |
| 195 | 180 |
| 234 | 236 |
| 256 | 260 |
| 275 | 278 |
| 296 | 296 |
| 322 | 316 |
| 15 | 360 |

Given this particular example of the present invention with a 15 degree offset, the effect on cycle dynamics of the compressor portion 10L will now be considered. The relationship between piston position and crank angle is different at most points throughout the cycle from TPP to BPP and back to TPP for the compressor of the present invention as compared to the slider crank. This condition causes a corresponding change in piston velocity and acceleration at any particular point in the cycle. These differences in cycle dynamics have an impact upon certain basic performance characteristics of the compressor 10L, such as pumping losses and volumetric efficiency. Besides the friction due to mechanical crankcase components and piston against cylinder, there is a large friction loss in reciprocating piston engines attributable to intake throttling. That is, the energy required to draw the fuel/air charge into the combustion chamber. These friction losses are related to volumetric inefficiency which contributes to poor engine performance. It is well known that the better an engine "breathes" the more powerful and efficient the engine is. Besides the restrictions on volumetric efficiency caused by the shape and dimensions of the manifold and valve ports, the cycle dynamics of the slider crank engine also limit volumetric efficiency. The compressor portion 10L of the present invention with altered cycle dynamics can achieve a higher volumetric efficiency than the slider crank by increasing piston acceleration after TDC. The greater piston acceleration after TDC establishes an increased pressure differential early in the charge or intake stroke of the compressor. This overcomes the inertia of the input charge and sets up a scavenging effect later on in the cycle after BPP. Piston position need not be fixed at one set degree of advance relative to crank angle throughout the entire 360 degree of crank travel but can be varied by cam slot shape throughout the full range of crank motion.

The optimal cycle dynamics of the working portion 10R of the engine differ from that of the compressor portion 10L. For example, it is preferable to dwell the pistons of the working portion 10R at TPP and exert maximum pressure when the crank is in excess of 40 degrees past TDC. If an offset of 48 degrees between the zero degree point and the TPP is effected, piston dwell at TPP will be increased substantially. Because TPP occurs 48 degrees beyond the zero degree mark, the advanced crank arm of the present invention provides slightly increased volume for each additional degree of crank rotation as compared to the slider crank engine. An increased dwell at BPP also permits greater induction of fuel air mixture (increases volumetric efficiency). An increased dwell at BPP allows more of the unburned exhaust gas to escape from the exhaust valve reducing the quantity of exhaust gas that must be pumped from the cylinder. This increase in volume per crank angle decreases the time for heat transfer from the combustion products and the cylinder and piston. For this reason, a greater portion of the combustion energy is available for useful work. With extended dwell time at TPP and BPP, slightly accelerated volume progression and the possibility of improved ignition characteristics, a more uniform, lower combustion temperature gradient is feasible. This lower temperature gradient reduces the non-equilibrium reaction of nitrogen and oxygen caused at high peak combustion temperature as well as the dissociation of $CO_2$ into CO and $O_2$. As has been shown above, the present invention permits the cycle dynamics of the engine to be altered such that a lower compression ratio can be employed to accomplish the same degree of compression occurring in a slider crank engine without any crankshaft angle offset. Furthermore, the increased acceleration of the piston away from TPP on the expansion stroke prevents pressure and temperature buildup resulting from a flame front which greatly outpaces piston movement. In this manner, the temperature of combustion can be reduced and the rate of expansion of combustion products more closely matched with piston movement with a resultant increase in efficiency and a decrease in CO and NOx emissions.

In addition to the foregoing positive effects of offsetting the crank angle from TPP, an advanced angle also provides an increased moment arm upon which the piston can act. In the slider crank engine, peak compression occurs when the crankpin is disposed at zero degrees when there is no moment arm. As a result, the slider crank engine can do no work while the piston is at TPP. To compensate for this the ignition is timed so that peak combustion pressure occurs at about 15 degrees after TDC. However, at 15 degrees after TDC, the compression ratio is much less than at TDC. For example, if a slider crank engine has a 9:1 compression ratio, at 15 degrees after TDC the compression ratio is only 5:1. The present invention, by allowing crank angle offsets from TPP, allows the compression ratio to be reduced and the creation of peak combustion pressure at TPP which can be made to correspond, e.g., to a 40 degree crank angle. Of course, if the compression ratio can be reduced to accomplish the same efficiency of combustion as is achieved in an engine using higher compression ratio, pumping losses are reduced.

Yet another positive effect from the alteration of cycle dynamics, is the potential effects upon compression efficiency. The present invention permits greater acceleration of the piston during the first degrees after BPP than can be accomplished with the slider crank engine. This leads to greater compression stroke efficiency in that during the early degrees after BPP when the gas density and pressure are low, the piston is moved further than in slider crank engines. When compression pressures increase, more degrees of crankshaft rotation are dedicated to further compression.

While the working portion 10R of the present invention has been described in terms of a constant 40 degrees crank angle offset, it should be understood that the slot/cam shape are continuously variable so that the cycle dynamics may be varied over a wide range.

Having now described a first embodiment of the present invention wherein a pair of compressor cylinders are mated to a pair of working cylinders operating on a four-stroke cycle, additional embodiments shall now be described. A second embodiment is illustrated in FIGS. 6–9 and a third embodiment is illustrated in FIGS. 10–13. In describing the following embodiments, elements illustrated in FIGS. 6–13 which correspond to the elements described above with respect to FIGS. 1–5 have been designated by corresponding reference numerals increased by two hundred and four hundred, respectively. The embodiments of FIGS. 6–13 operate in the same manner as the embodiment of FIGS. 1–5 unless otherwise stated.

Figure 6:
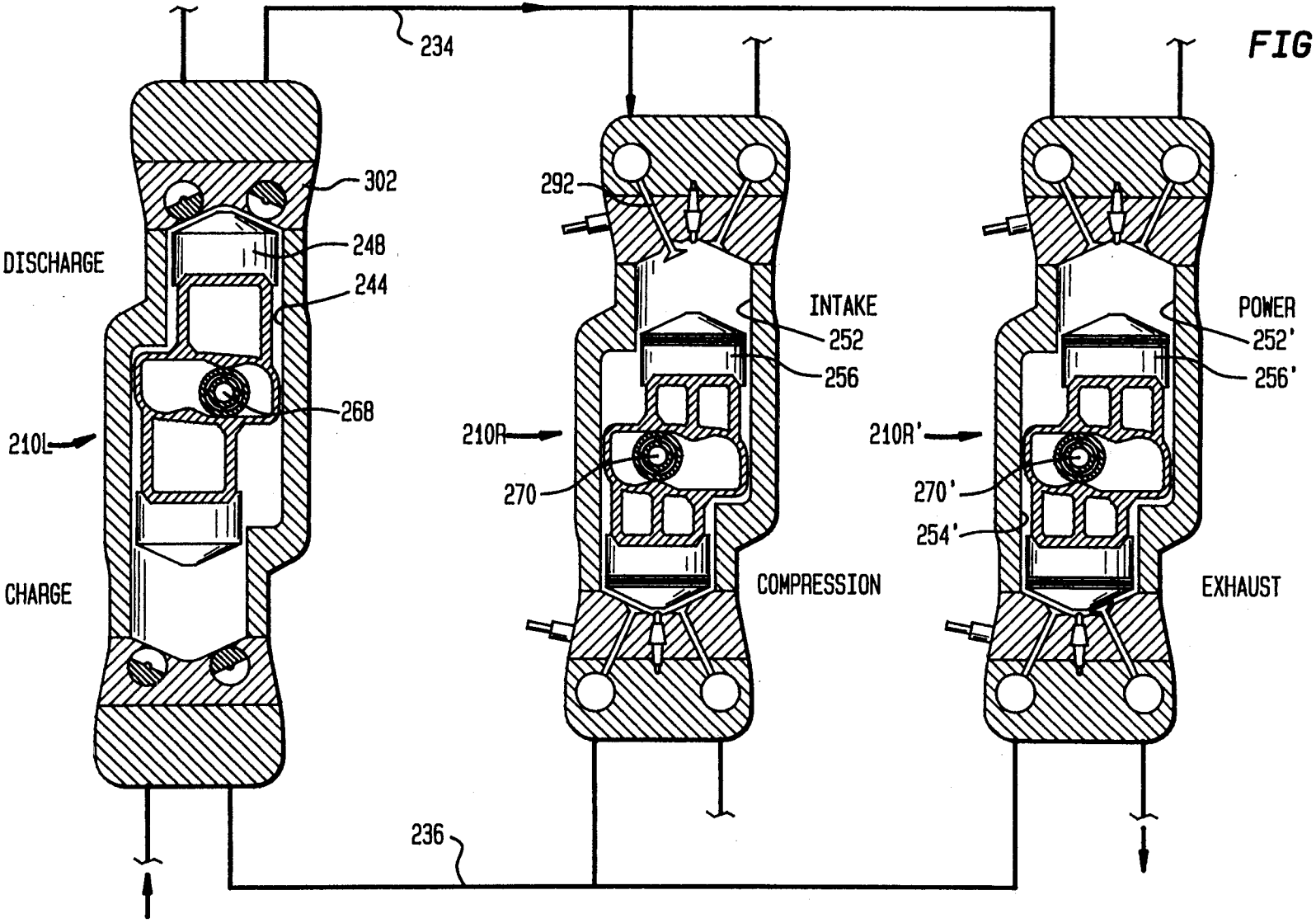
FIGS. 6–9 are diagrams having the same import as FIGS. 2–5, but of an engine having six cylinders rather than four.
Figure 7:
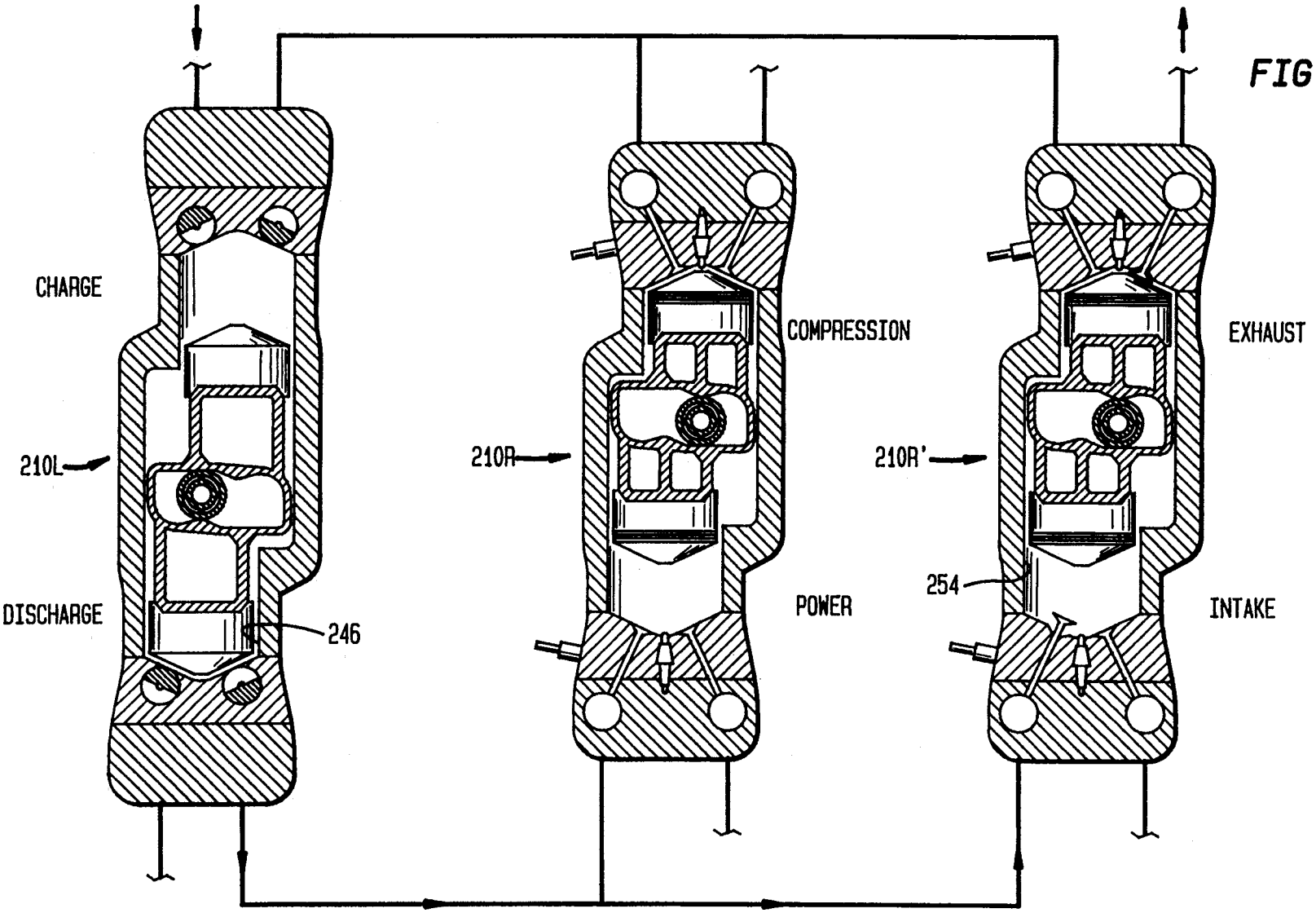
Figure 8:
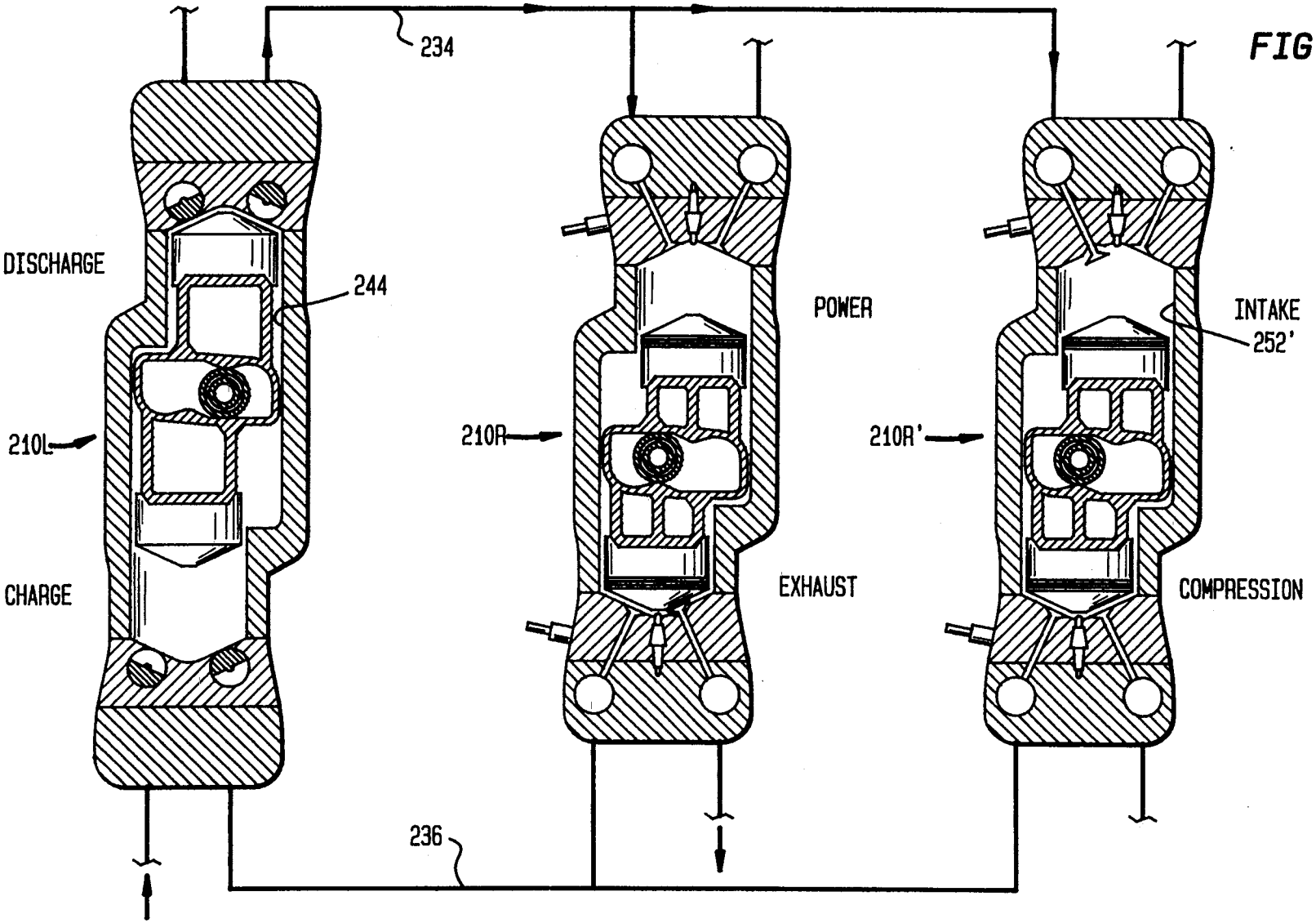
Figure 9:
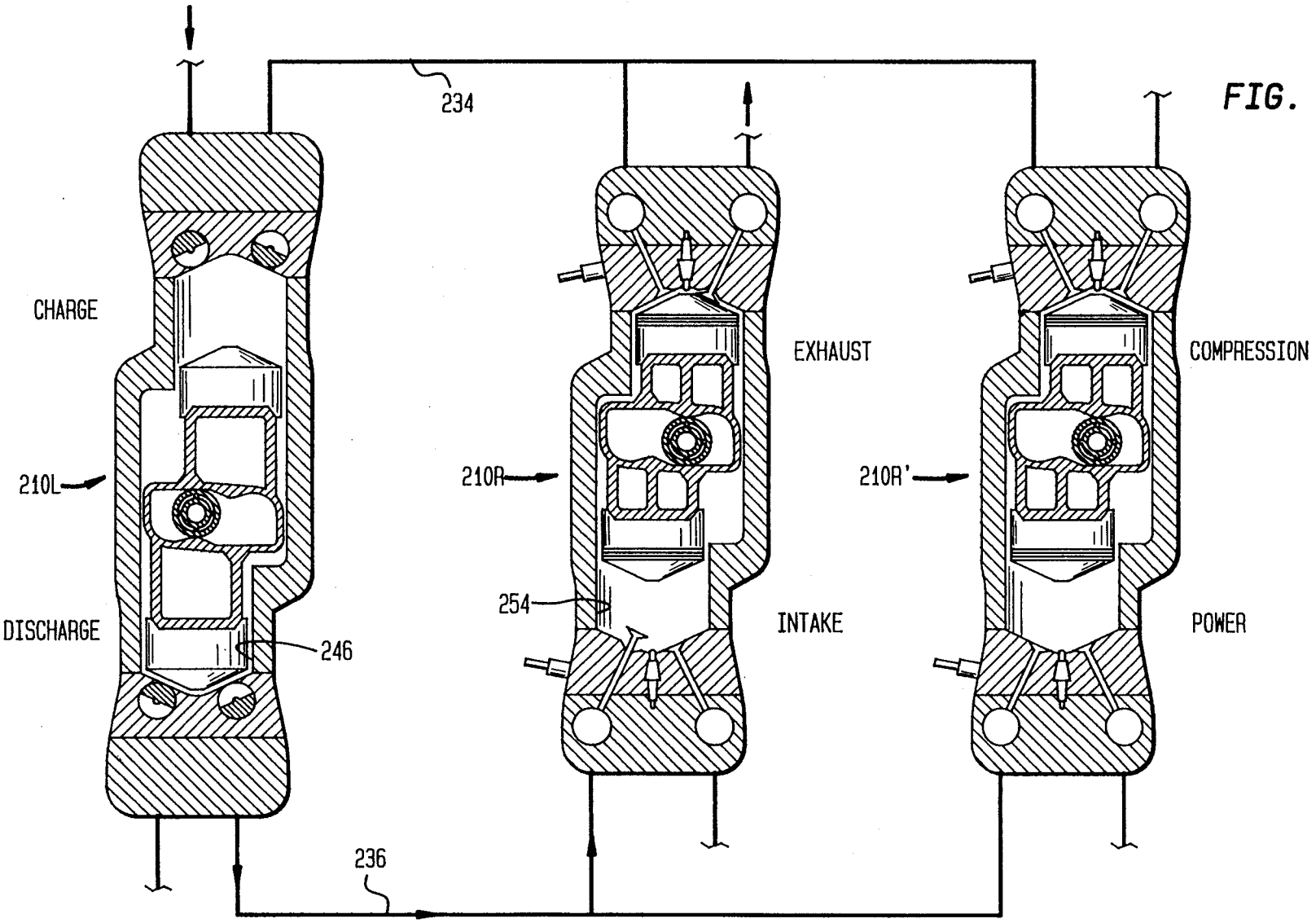

FIGS. 6–9 depict a stroke specialized internal combustion engine with stroke specialized cylinders similar to that which are depicted in FIGS. 2–5 except that there are four working cylinders 252, 254, 252' and 254'. The compressor portion of the engine 210L is totally analogous to the compressor portion 10L depicted in FIGS. 2–5. The first working pair of cylinders 210 is analogous to the set of working cylinders 10R depicted in FIGS. 2–5. To further illustrate this analogous relationship, the sequence of drawings FIGS. 5–6 illustrate the same exact phase relationship between the compressor section 210L and the working portion 210R as is depicted in FIGS. 2–5 with respect to the compressor portion 10L and the working portion 10R. For example, FIG. 6 shows the compressor piston 248 at the TPP with the outlet valve 302 open and permitting a discharge of pressurized air to escape from cylinder 244. This is exactly the same position occupied by piston 48 and cylinder 44 as depicted in FIG. 2. Similarly, in FIG. 6 the working portion 210R of the engine has the working cylinder 256 at BPP with the intake vale 292 open allowing a influx of air which is being pressed into the bridge manifold 234 and enters cylinder 252 on the intake stroke as shown. This is analogous to the position of piston 56 and cylinder 52 as depicted in FIG. 2. This phase relationship is preserved in each of the FIGS. 6–9 to illustrate that the difference between the six-cylinder engine depicted in FIGS. 6–9 is merely the addition of an extra two set of working cylinders 252' and 254' within a second working section 210R'. Working section 210R' is not depicted in FIG. 1 but FIG. 1 could be altered by merely replicating 210 the rear portion of the engine that is the cylinder/piston set occupying the rear position at the front of the engine such that the compressor portion 210L would be two cylinders in the center of the engine and there would be a working pair of cylinders on either end. The bridge manifold in this case would be W-shaped. As in the previous embodiment, crankpin 270 is at a 180 degree offset with respect to crankpin 268 of the compressor portion 210L. In the second pair of working cylinders in section 210R', the crankpin is in phase with the first pair of working cylinders that is 270' and 270 have the same index relative to 268. The valve timing between 210R and 210R' is offset however such that piston 256 is on the intake stroke in section 210R as depicted in FIG. 6 whereas 256' is on the power stroke. The timing of the respective working portions 210R and 210R' is offset in order to alternately receive within alternate working cylinders the output from the compressor portion 210L. For example, in FIG. 6, the output from cylinder 244 of section 210L is discharged through valve 302 and into cylinder 252 of 210R. In FIG. 7 the discharge from compressor section 210L i.e., from cylinder 246 is received by cylinder 254. In FIG. 8, the output of the compressor portion 210L from cylinder 244 is received by cylinder 252'. In FIG. 9, the output from cylinder 246 is received by cylinder 254 of section 210R. Because for each discharge stroke of the compressor portion there is a cylinder which is on the intake stroke in the corresponding power cylinders in sections 210R and 210R', the bridge manifold 234 does not need to receive and store the output from an entire stroke from compressor portion 210L. This situation is symbolized by bridge manifold 234 being depicted as a line rather than a rectangle, since it may be viewed as having no volumetric capacity for storing discharge air from the compressor portion and instead merely acts as a conduit. It should further be noted that since the compressor is not effectively delivering two full volumes of air for each intake stroke, substantially less air is delivered to the working cylinder on the intake stroke. Greater or lesser amounts of discharge air from the compressor portion 210L can be realized by varying the stroke and bore of the compressor portion.

Figure 10:
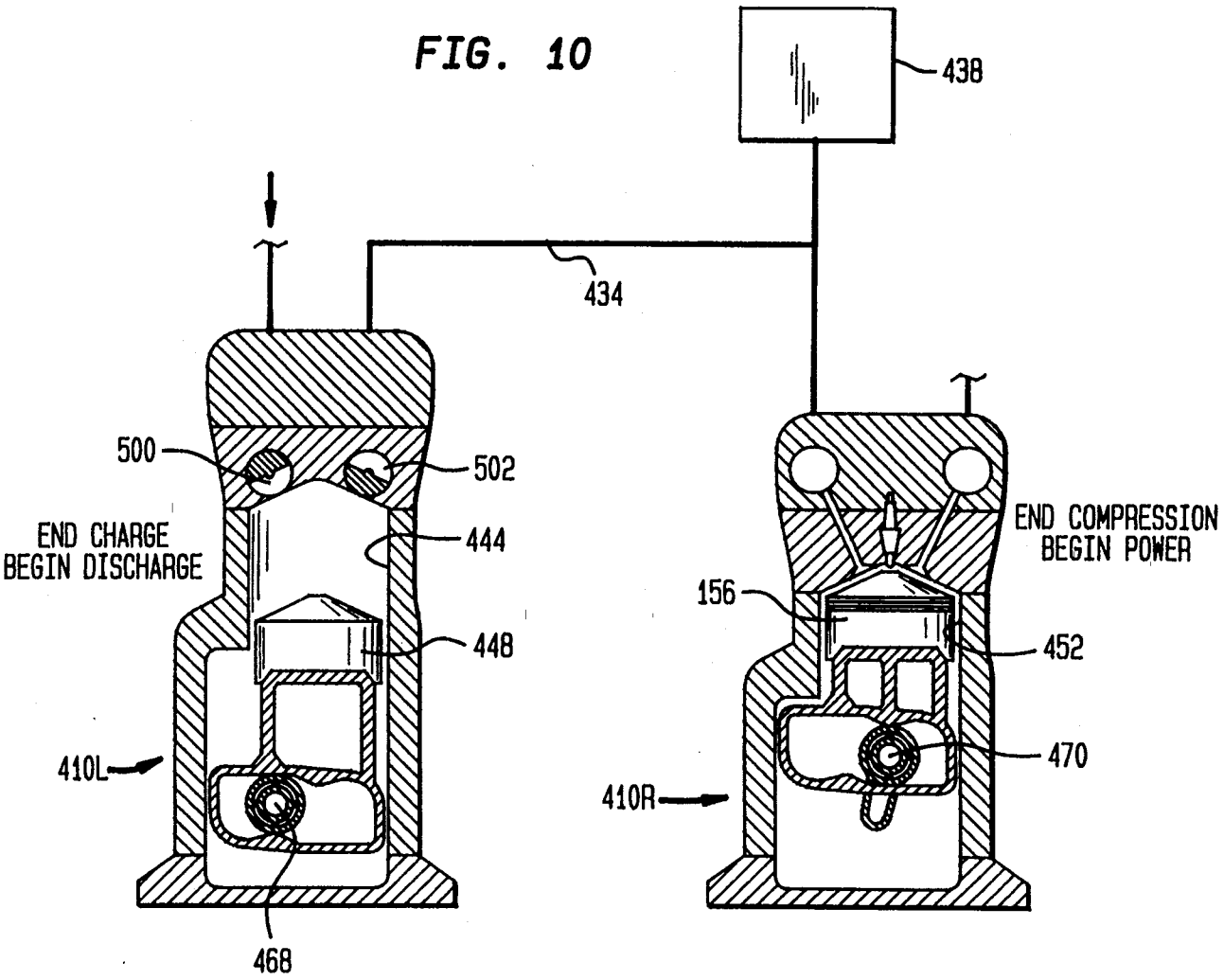
FIGS. 10–13 are diagrams having the same import as FIGS. 2–5 and 6–9, but of a two-stroke engine having two cylinders in lieu of a four-stroke engine with either four or six cylinders.
Figure 11:
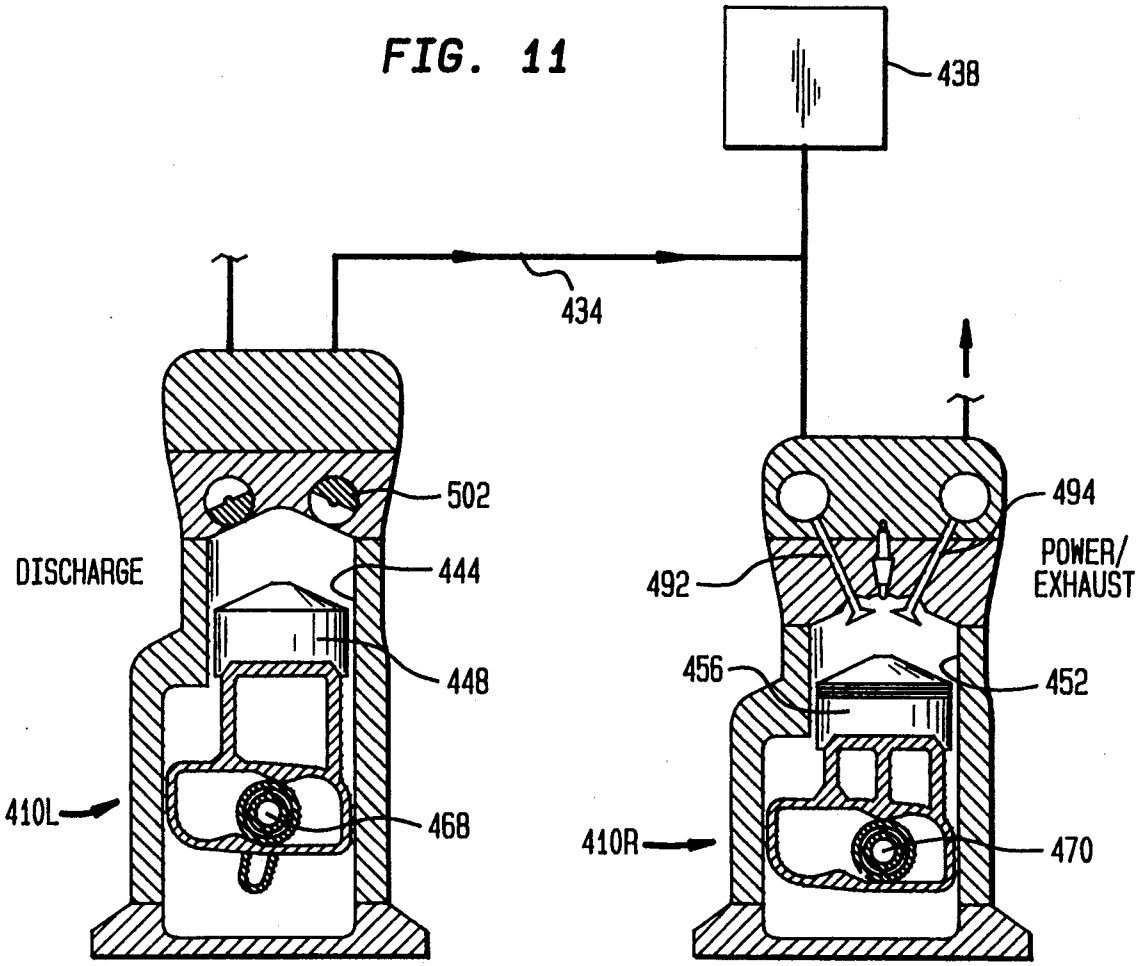

FIGS. 10–13 illustrate the present invention as applied to a two-stroke engine with a pair of cylinders that are in line 444 and 452. As before, the crankpins 468 and 470 are disposed 180 degrees offset relative to each other. In FIG. 10 the compressor portion 410L is shown with a piston 448 at the bottom piston position with the intake valve 500 still open, this identifies this position as the end of the charge stroke and the beginning of the discharge stroke. In FIG. 10, the working portion of the engine 410R is at the end of the compression stroke with the power piston 456 proximate to top piston position within the cylinder 452 and ready to fire to begin the power stroke. A fuel injector is depicted as a rectangle 438 for the purposes of illustration in FIGS. 10–13. In FIG. 11, the crankpins 468 and 470 have advanced approximately 90 degrees from the position shown in FIG. 10. This advance has moved piston 448 of the compressor portion approximately halfway up in cylinder 444 on the discharge stroke. The bridge manifold 434 conducts the output received through valve 502 into cylinder 452 through valve 492 at the same time valve 494 is opened permitting exhaust to take place. In the working portion of the engine 410R the piston 456 has been driven down to approximately midstroke within cylinder 452 and this depicts the power and exhaust stroke of the two-cycle engine. The opening of the exhaust valve 494 is characteristic of a two-cycle engine halfway through its powerstroke and the opening of intake valve 492 is similarly typical in that the influx of the fresh charge assists in removing exhaust gases from the cylinder. On conventional two-stroke engines, this displacing effect of the intake charge is normally accomplished through a porting system rather than cam actuated poppet valves. Since the compressor portion 410L is essentially an air compressor on applications utilizing a fuel injector 438, the pumping of air from the compressor 410L into the working portion 410R during the power exhaust stroke as depicted in FIG. 11 does not result in wasting fuel or polluting the atmosphere since the intake charge does not necessarily have to include fuel at this stage.

Figure 12:
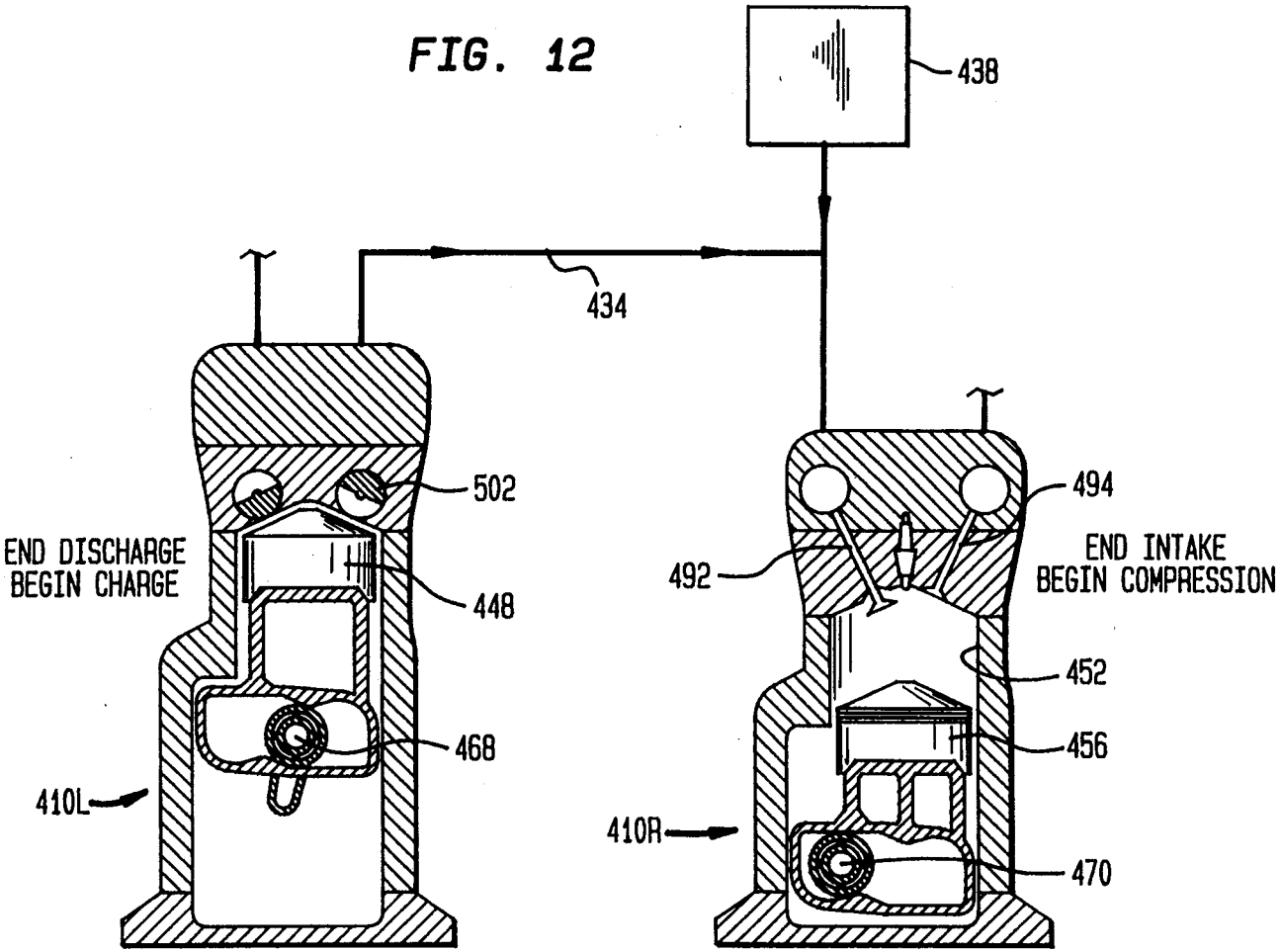

In FIG. 12, the injection of fuel from the fuel injector 438 into working cylinder 452 is depicted by an arrow in the line connecting fuel injector 438 to the inlet valve 492 of the working portion 410R. In FIG. 12 the crankpins 468 and 470 have advanced approximately 90 degrees from the position shown in FIG. 11 such that piston 448 is approximately at top piston position at the end of the discharge stroke and/or the beginning of the charging stroke. Valve 502 remains opened taking advantage of the scavaging effect to remove all air from the compressor portion 410L into the bridge manifold 434 and over to the working portion 410R. The piston 456 of the working portion 410R has reached approximately bottom piston position and the intake valve 492 remains open to receive residual air traversing the bridge manifold 432 due to scavaging effect and inertia as well as the fuel charge from fuel injector 438. Thus, the working portion 410R can be recognized as being at the end of the intake stroke and the beginning of the compression stroke.

Figure 13:
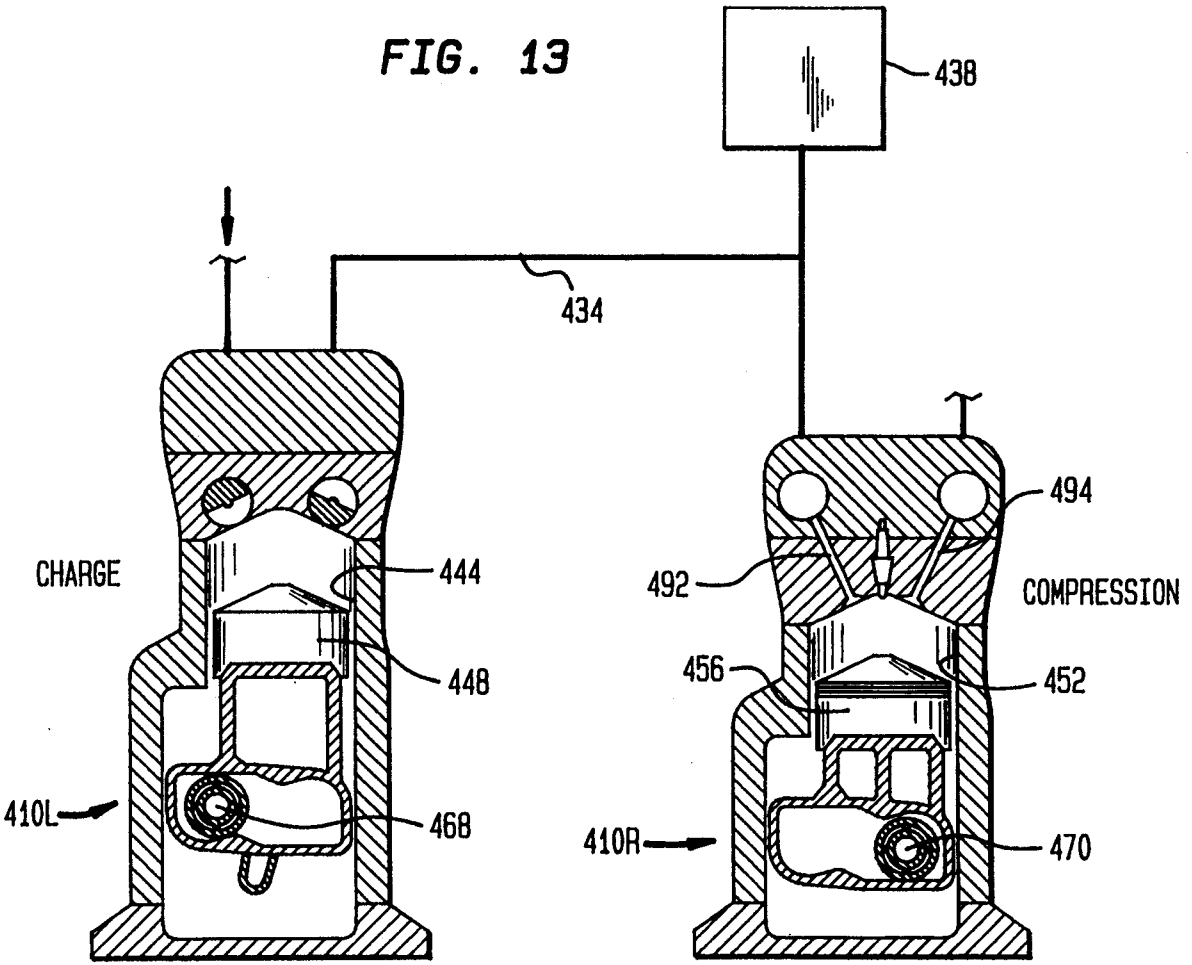

FIG. 13 shows the crankpins 468 and 470 advanced another 90 degrees beyond the position shown in FIG. 12. This brings the piston 448 of the compressor portion 410L approximately half way down cylinder 442 on the intake stroke. Piston 456 in cylinder 452 of the working portion of the engine 410R is on the compression stroke. This can easily be recognized due to the fact that both intake poppet valves 492 and 494 are closed.

It should be understood that the embodiments described herein are merely exemplary and that a person skilled in the art may make many variations and modifications without departing from the spirit and scope of the invention as defined in the appended claims. For example, an engine employing a scotch yoke compressor section in combination with a conventional slider crank working portion with both portions being driven by the same crankshaft could readily be produced in accordance with the teachings of the present invention.

I claim:

1. A reciprocating piston internal combustion engine having a plurality of cylinders for slideably receiving a corresponding plurality of mated pistons therein moving in synchronous reciprocation relative to the rotation of a crankshaft, comprising:

(a) a shuttle having a slot therein affixed to a first of said plurality of pistons, said slot receiving a crankpin of said crankshaft for interconverting between reciprocating motion of said first piston and rotary motion of said crankshaft, said interconverting characterized by an angular displacement of said crankshaft to an orientation advanced beyond 0 degrees at top piston position; and (b) means for interconverting between reciprocating motion of the remainder of said plurality of pistons and rotary motion of said crankshaft, at least one of said plurality of cylinders dedicated to infusing an intake charge into at least one other of said plurality of cylinders, the at least one other of said plurality of cylinders capable of serving as a combustion chamber.

2. The engine of claim 1, further including means for conducting said intake charge from said at least one dedicated cylinder to said at least one other combustion chamber cylinder and means for controlling passage of said intake charge from said at least one dedicated cylinder to said at least one other combustion chamber cylinder.

3. The engine of claim 2, wherein said at least one dedicated cylinder receives said first piston and said angular displacement of said crankshaft associated therewith provides improved cycle dynamics for infusing said intake charge.

4. The engine of claim 3, wherein said means for interconverting between reciprocating motion of the remainder of said plurality of pistons and rotary motion of said crankshaft includes a scotch yoke.

5. The engine of claim 4, wherein said at least one other combustion chamber cylinder is said remainder of said plurality of pistons and said interconversion by said scotch yoke is characterized by an angular displacement of said crankshaft to an orientation advanced beyond 0 degrees at top piston position.

6. The engine of claim 5, wherein said angular displacement beyond 0 degrees at top piston position associated with said first piston is not equal to said angular displacement beyond 0 degrees at top piston position associated with at least one of said remainder of said plurality of pistons.

7. The engine of claim 6, wherein said at least one other combustion chamber cylinder supports a four stroke cycle.

8. The engine of claim 6, wherein said at least one other combustion chamber cylinder supports a two stroke cycle.

9. The engine of claim 6, wherein said at least one other combustion chamber cylinder executes a diesel cycle.

10. The engine of claim 6, wherein said means for controlling passage of said intake charge from said at least one dedicated cylinder to said at least one other combustion chamber cylinder includes a rotary valve.

11. A reciprocating piston internal combustion engine having a plurality of cylinders for slideably receiving a corresponding plurality of mated pistons therein moving in synchronous reciprocation relative to the rotation of a crankshaft, comprising:

(a) a shuttle having a slot therein affixed to a first of said plurality of pistons, said slot receiving a crankpin of said crankshaft for interconverting between reciprocating motion of said first piston and rotary motion of said crankshaft, said interconverting characterized by resultant cycle dynamics differing from those associated with a slider crank engine; and (b) means for interconverting between reciprocating motion of the remainder of said plurality of pistons and rotary motion of said crankshaft, at least one of said plurality of cylinders dedicated to infusing an intake charge into at least one other of said plurality of cylinders, the at least one other of said plurality of cylinders capable of serving as a combustion chamber.

12. The engine of claim 11, further including means for conducting said intake charge from said at least one dedicated cylinder to said at least one other combustion chamber cylinder and means for controlling passage of said intake charge from said at least one dedicated cylinder to said at least one other combustion chamber cylinder, wherein said at least one dedicated cylinder receives said first piston and said resultant cycle dynamics associated therewith provides improved cycle dynamics for infusing said intake charge, and wherein said means for interconverting between reciprocating motion of the remainder of said plurality of pistons and rotary motion of said crankshaft includes a scotch yoke.

13. The engine of claim 12, wherein said means for interconverting between reciprocating motion of said remainder of said plurality of pistons and rotary motion of said crankshaft is characterized by resultant cycle dynamics differing from those associated with a slider crank engine.

14. The engine of claim 13, wherein said resultant cycle dynamics associated with said first piston is not equal to said resultant cycle dynamics associated with at least one of said remainder of said plurality of pistons.

15. The engine of claim 14, wherein said at least one other combustion chamber cylinder supports a four stroke cycle.

16. The engine of claim 14, wherein said at least one other combustion chamber cylinder supports a two stroke cycle.

17. The engine of claim 15, wherein said at least one other combustion chamber cylinder executes a diesel cycle.

* * * * *